United States Patent [19]

Engelhardt

[11] 4,321,768

[45] Mar. 30, 1982

[54] EDUCATIONALLY CORRELATIVE AMUSEMENT DEVICE

[76] Inventor: Ervin C. Engelhardt. 717 S. Pleasant, Lodi, Calif. 95240

[21] Appl. No.: 167,776

[22] Filed: Jul. 10, 1980

[51] Int. Cl.[3] ..... A63H 33/26

[52] U.S. Cl. ..... 46/227; 40/550; 273/1 E; 434/258

[58] Field of Search ..... 434/258; 46/1 B, 32, 46/226, 227, 228, 229, 45; 273/1 E, 1 GC; 40/550

[56] References Cited

U.S. PATENT DOCUMENTS 3,162,977 12/1964 Elisher ..... 46/228 X
3,204,367 9/1965 Stubbmann ..... 46/32
3,654,710 4/1972 Barnard ..... 434/258
3,982,764 9/1976 Dieball ..... 434/169 X

*Primary Examiner*—William H. Grieb
*Attorney, Agent, or Firm*—Blair, Brown & Kreten

[57] ABSTRACT

Disclosed herein is a device for amusing young children and the like by utilization of correlatives electronically provided for educational benefit. The device includes a housing adapted to be affixed to a safety seat and an automobile within which the child is placed and includes a source of power, a display board which appears to have the visage of a person or the like, and a control panel having plural switches thereon for selected engagement of various groups of lights provided on the visage. By appropriate switching, various aspects of the amusement face can be illuminated.

9 Claims, 3 Drawing Figures

EDUCATIONALLY CORRELATIVE AMUSEMENT DEVICE

BACKGROUND OF THE INVENTION

Educators and behaviorial scientists have long debated and studied the causal relationship between stimuli and response among higher forms of life. Irrespective, the importance in establishing an awareness in children for cause and effect is not only a fundamental aspect in the educative and maturation process, but it can also be potentially a source of amusement for children.

The following patents reflect the state of the art of which applicant is aware in so far as they appear to be relavent to that which is taught in the instant application:

U.S. Pat. No. 3,654,710—Barnard

U.S. Pat. No. 3,982,764—Dieball

Barnard teaches the use of a selectively illuminable toy wherein a rotary switch is operatively connected between a power source and a display such as a plurality light bulbs, light conductive rods, or the like wherein rotation of the knob selectively engages one of the lights.

Dieball teaches the use of an electrical game apparatus requiring chance and skill in which a scrambler is interposed between a plurality of switches and a display means so that the outcome of switch manipulation can conceivably involve memory as well as luck.

Each of these references may be characterized by noting that in the former, a relatively small number of lights are capable of illumination, and when so illuminated provide no distinctive correlation with a simulative object like a face, and the latter requires a considerable degree of skill somewhat in excess of that which is desired in the instant application, and further the absence of a simulative type of display has not been provided.

By way of contrast, the instant application is directed to and claims a device adapted for amusing young children and the like benefiting from the educational correlative pattern intrinsic to most healthy young children which device is capable of deployment in an automobile having a child safety seat, for the child's amusement while in transit, the device having a plurality of switches each of which selectively engages various portions of a display panel simulative of a face so that selective engagement of different switches will provide illumination of different portions of the face allowing the child to correlate switch deployment with different face portions.

OBJECTS AND SUMMARY OF THE INVENTION

Accordingly, it is an object of this invention to provide a device which allows the child to correlate various face portions with switch deployment so as to provide beneficial educative correlation.

It is a further object of this invention to provide a device of the character described above which is safe to operate and of an amusing character for the child so that trips in the car by the child can be spent in an amusing and beneficial manner.

It is a further object of this invention to provide a device of the character described above in which plural switches are provided each of which is operatively engaging various portions of a display suggestive of a face for the benefits to the child.

It is a further object of this invention to provide a device of the character described above which is relatively inexpensive to manufacture, extremely durable in construction, and formed from suitable material that is safe for children's use.

It is yet a further object of this invention to provide a device of the character described above in which no sharp edges are provided so as not to provide or pose a hazard for the child.

It is yet a further object of this invention to provide a device of the character described above which can be characterized in the provision of a toy or amusement device capable of being affixed to the child's safety seat commonly found in an automobile adapted for rapid deployment or removal, and operatively connected to a source of power such as the cigarette lighter of a car having switching means disposed between the power source and plural display means so that selected deployment of the display means is possible.

These and other objects will be made manifest when considering the following detailed specification when taken in conjunction with the appended drawing figures.

DESCRIPTION OF THE PREFERRED EMBODIMENT

Figure 1:
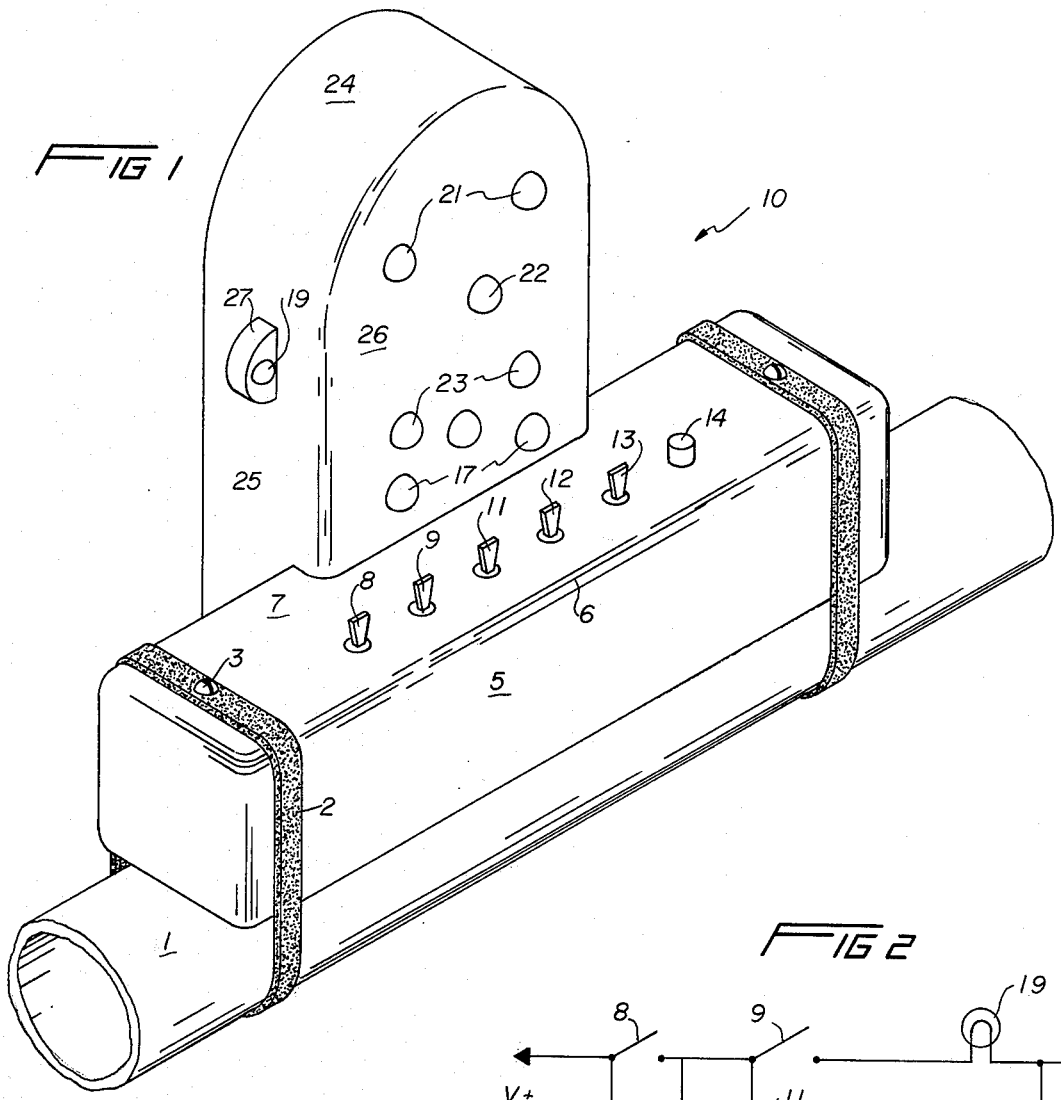
FIG. 1 is a perspective view of the apparatus according to the present invention.

Referring now to the drawings, wherein like reference numerals refer to like parts throughout the various drawing figures, reference numeral 10 is directed to the educationally correlative amusement device according to the present invention.

The device 10 has a first portion 5 of substantially rectangular configuration having rounded corners so as to minimize the likelihood of sharp surfaces engaging the child, and a second portion having a front and back face 26, vertical walls 25, and a curved top portion 24 in which ears 27 are provided at the transition area between the curved top portion 24 and the vertical portion 25, simulative of ears. The ears 27 have lights 19 for purposes to be assigned later.

The front face 26 of the second portion is provided with a first upper pair of lights 21 suggestive of eyes, a medially disposed further light 22 suggestive of a nose, and upper and lower light arrays 23 and 17 respectively which are suggestive of a smile or a frown.

Figure 3:
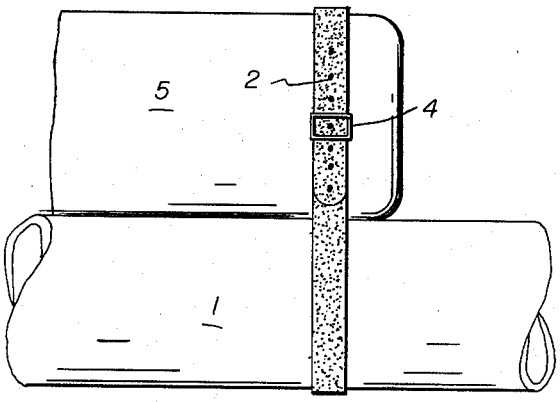
FIG. 3 is a rear view of a portion of the device shown in FIG. 1 showing the means for affixing the device according to the present invention to a child's safety seat bar commonly used in automobiles.

Operatively connected to these plural lights defining display means, are switching means disposed on a top face 7 of the first portion 5. The first portion 5 is connected (and therefore so is the second portion) to the bar 1 of the child's safety seat commonly found in an automobile by means of straps 2 which are tethered to the first portion by means of rivets, screws, or the like 3. FIG. 3 shows how the strap 2 is affixed for secure engagement of the first portion 5 with the bar 1 by means of a strap 2 having a lock formed from a buckle 4.

The top face 7 of the first portion is provided with switches 8, 9, 11, 12, 13 and a push button 14 whose relevance in conjunction with the light bulbs will now be made evident when further considering FIG. 2.

Figure 2:
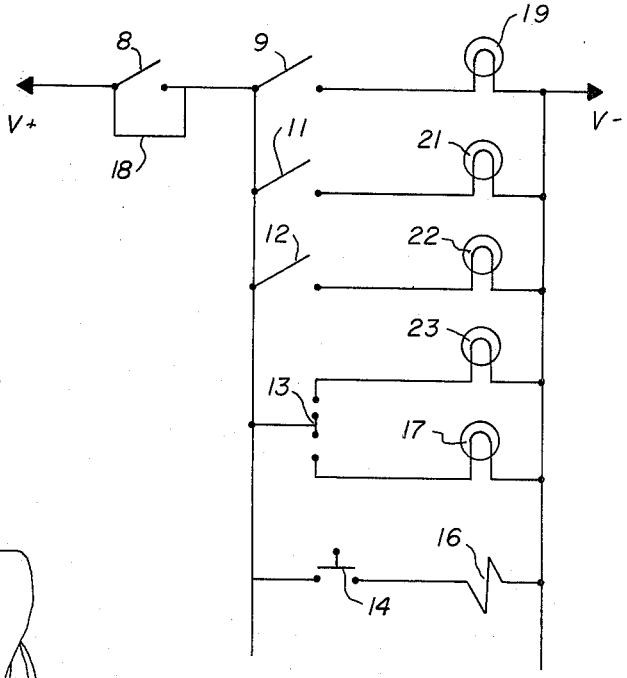
FIG. 2 is a schematic depiction of the electrical circuitry associated therewith.

The circuit shown in FIG. 2 is operatively connected to a source of power, for example, a twelve volt battery commonly found in automobiles engageable by means of insertion of the circuit into a cigarette lighter. Connected in series between the voltage source is a switch 8 which when open activates a flasher 18 so as to effect the other switches and/or lights by intermittent pulsing thereof.

Remaining lights and a horn are connected in parallel to each other and in series with the power source and switches are disposed in such a way that when one switch is closed, its associated light will be illuminated. For example, switch 9 is adapted to illuminate bulbs 19 which will provide illumination for the ears, switch 11 is correlated with bulbs 21 for illumination of the eyes, switch 12 operatively illuminates light 22 and so on.

Switch 13, in association with the upper portion of the mouth or smile 23 and the lower portion 17 or the frown is defined by a three-positioned toggle switch which either energizes the smile, the frown, or neither as desired by the child. Lastly, a push button 14 is operatively associated with a horn 16 so that the child can enhance his pleasure and learning by beeping the horn as desired.

Having thus described the invention, it should be apparent that there has been provided an educationally correlative amusement device wherein display means are discreetly connected to plural switching means for the selective engagement thereof, and the display means when taken in its entirety are suggestive of the human visage, so that a child can associate switching with different light portions.

Further, it should be apparent that numerous structural modifications are contemplated as being a part of this invention as set forth hereinabove and as defined hereinbelow by the claims.

What is claimed is:

1. An educationally correlative amusement device comprising a housing adapted to be affixed to a bar portion of a child's automobile safety seat and having:

a source of power, plural discreet display means, and plural discreet switching means interposed between said source of power and said display means on said housing whereby each said discreet switching means correlates to only one of said display means thereby requiring the child to selectively engage said switching means to alter the total effect of said display means, wherein a first of said display means are lights simulating either a smile or a frown actuated by a three position toggle switch for selective engagement of a smile, frown, or neither.

2. The device of claim 1 wherein said housing is formed from two portions: a first portion which contains said switching means and affixes to the safety seat bar, and a second portion attached to a back face of said first portion, said second portion carrying said display means being simulative of a head.

3. The device of claim 2 wherein said first portion has extremities having strap means tethered thereto for attachment to the bar portion of said safety seat.

4. The device of claim 3 wherein a fourth said display means are lights provided on ear like projections actuated by a fourth toggle switch.

5. The device of claim 3 wherein a second of said display means are lights simulating eyes actuated by a second toggle switch.

6. The device of claim 5 wherein a third of said display means is a nose light actuated by a third toggle switch.

7. The device of claim 1 wherein a flashing means is interposed between said power source and said switching means actuated by a further toggle switch for flashing, intermittent engagement of said display means.

8. The device of claim 7 including a push button horn on said first portion operatively connected to said power source.

9. The device of claim 8 wherein edges of said first and second portions are rounded for safety.

* * * * *